US005836072A

United States Patent [19]

Sullivan et al.

[11] Patent Number: 5,836,072

[45] Date of Patent: Nov. 17, 1998

[54] METHOD OF ASSEMBLING AN ANTENNA AND OVER-MOLDING THE SAME WITH A THERMOPLASTIC MATERIAL

[76] Inventors: Jonathan Lee Sullivan, 3733 "C" St., Lincoln, Nebr. 68510; Douglas McKeown, 2021 S. 35th St., Lincoln, Nebr. 68506; Glen A. Wilcox, Box 129, Ceresco, Nebr. 68017; William P. Hayes, Lot S-1145 Woodcliff, Fremont, Nebr. 68025

[21] Appl. No.: 508,176

[22] Filed: Jul. 27, 1995

[51] Int. Cl.[6] ..... H01P 11/00

[52] U.S. Cl. ..... 29/600; 264/272.15; 264/272.19; 343/895

[58] Field of Search ..... 29/600, 601, 605; 264/272.19, 272.15; 343/895

[56] References Cited

U.S. PATENT DOCUMENTS 4,725,395 2/1988 Gasparaitis et al. ..... 264/272.19 X
5,596,797 1/1997 Bumsted ..... 29/600 X

*Primary Examiner*—Carl J. Arbes
*Attorney, Agent, or Firm*—Zarley, McKee, Thomte, Voorhees & Sease; Dennis L. Thomte

[57] ABSTRACT

The method of assembling an antenna and over-molding the same with a thermoplastic material is described which ensures that the elongated rod of the antenna is centrally positioned in its molding material and ensures that the helical spring of the antenna is also centrally positioned in the molding material. A sub-assembly is first created by connecting a helical spring to one end of an elongated metal rod and then inserting a threaded location mandrel in the spring. The assembled sub-assembly is then placed in an injection molding tool and is over-molded with a thermoplastic material. During the initial molding process, the metal rod and helical spring are centered in their respective cavities. The molded sub-assembly is then removed from the injection tool and placed in a second injection tool wherein the interior of the helical spring is filled with a thermoplastic material at the same time as an end cap is created. At the same time, the exposed end of the metal rod is also over-molded.

5 Claims, 4 Drawing Sheets

METHOD OF ASSEMBLING AN ANTENNA AND OVER-MOLDING THE SAME WITH A THERMOPLASTIC MATERIAL

BACKGROUND OF THE INVENTION

1. Field of the Invention

This invention relates to the method of assembling an antenna for a communications device and more particularly to the method of over-molding the antenna components with a thermoplastic material 2. Description of the Related Art In the fabrication or assembly of antennas for communication devices such as cellular telephones, two-way radios, transceivers, etc., many attempts have been made to properly enclose, by over-molding, the radiating element of the antenna. Many parts were required, for example, a molded top cap, a support ring, a bottom cap, tubing to cover the radiator shaft, helical radiator, connectors, etc. Inasmuch as the components of the antenna are quite delicate or fragile, it is difficult to ensure that the parts are centrally positioned within the molding material since the delicate parts are likely to deflect during the molding operation.

SUMMARY OF THE INVENTION

The method of assembling an antenna and over-molding the same with a thermoplastic material is described and comprises the steps of: (1) providing an elongated metal rod, metal fitting and elongated helical metal spring; (2) securing the metal fitting to one end of the metal rod; (3) securing one end of the spring to the metal fitting; (4) inserting a threaded portion of a location mandrel into the other end of the spring thereby creating a first sub-assembly; (5) placing the first sub-assembly into a first injection molding tool which has a first elongated cavity for receiving the metal rod therein and a second cavity for receiving the spring therein; (6) inducing a flowable thermoplastic material into the first and second cavities of the first injection molding tool to cover substantially all of the metal rod, the metal fitting, and to cover the exterior of the spring except for the second end thereof; (7) centering the metal rod in the first elongated cavity during the injection of the thermoplastic material therein; (8) centering the helical spring in the second cavity during the injection of the thermoplastic material therein; (9) maintaining the spring pitch distance of the spring during the injection of the thermoplastic material into the second cavity through the use of the threaded portion of the location mandrel; (10) allowing the thermoplastic material to cure for a predetermined length of time; (11) removing the over-molded first sub-assembly from the first injection molding tool; (12) removing the threaded portion of the location mandrel from the interior of the spring; (13) placing the over-molded first sub-assembly into a second injection molding tool which has at least a first cavity formed therein for receiving the over-molded metal rod and a second cavity being formed therein for receiving the over-molded spring as well as a third cavity located at the other end of the spring; and (14) introducing a flowable thermoplastic material into the third cavity to fill the interior of the over-molded spring and to create an end cap for the antenna.

In an embodiment of the method, a plastic coil form is inserted into the interior of the spring rather than the threaded portion of the location mandrel. In this embodiment, the plastic coil form remains in the interior of the spring during the molding operation in the second injection molding tool.

The finished product is such that the elongated metal rod and the helical spring, which form the two radiators for the antenna, are centrally positioned in the thermoplastic material.

It is therefore a principal object of the invention to provide an improved method for assembling an antenna and over-molding the same with a thermoplastic material.

Yet another object of the invention is to provide an antenna wherein the delicate parts thereof are centrally positioned in the thermoplastic molding material.

Still another object of the invention is to provide a method of assembling an antenna which eliminates the molding steps and which eliminates certain parts for the antenna.

Yet another object of the invention is to provide an improved method of assembling an antenna.

DESCRIPTION OF THE PREFERRED EMBODIMENT

Figure 1:
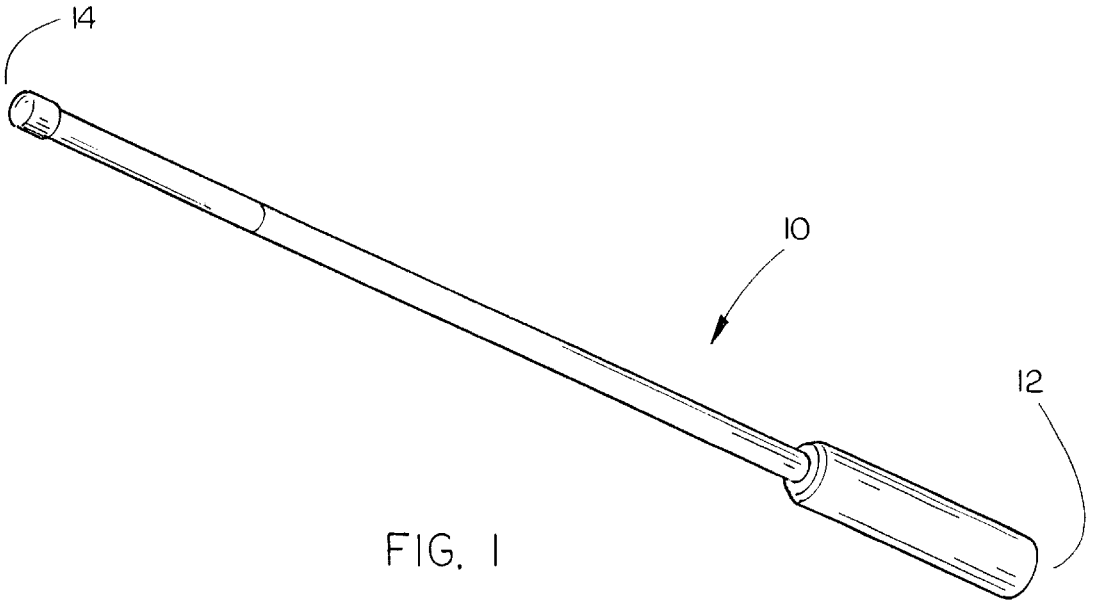
FIG. 1 is a perspective view of the antenna which is created through the method of this invention.

The numeral 10 in FIG. 1 refers to the antenna which is produced as a result of the method described herein. For purposes of description, the numeral 12 will refer to the upper end of the antenna while the numeral 14 will refer to the lower end of the antenna. The configuration of the lower end 14 of the antenna may vary as will be described hereinafter.

Figure 2:
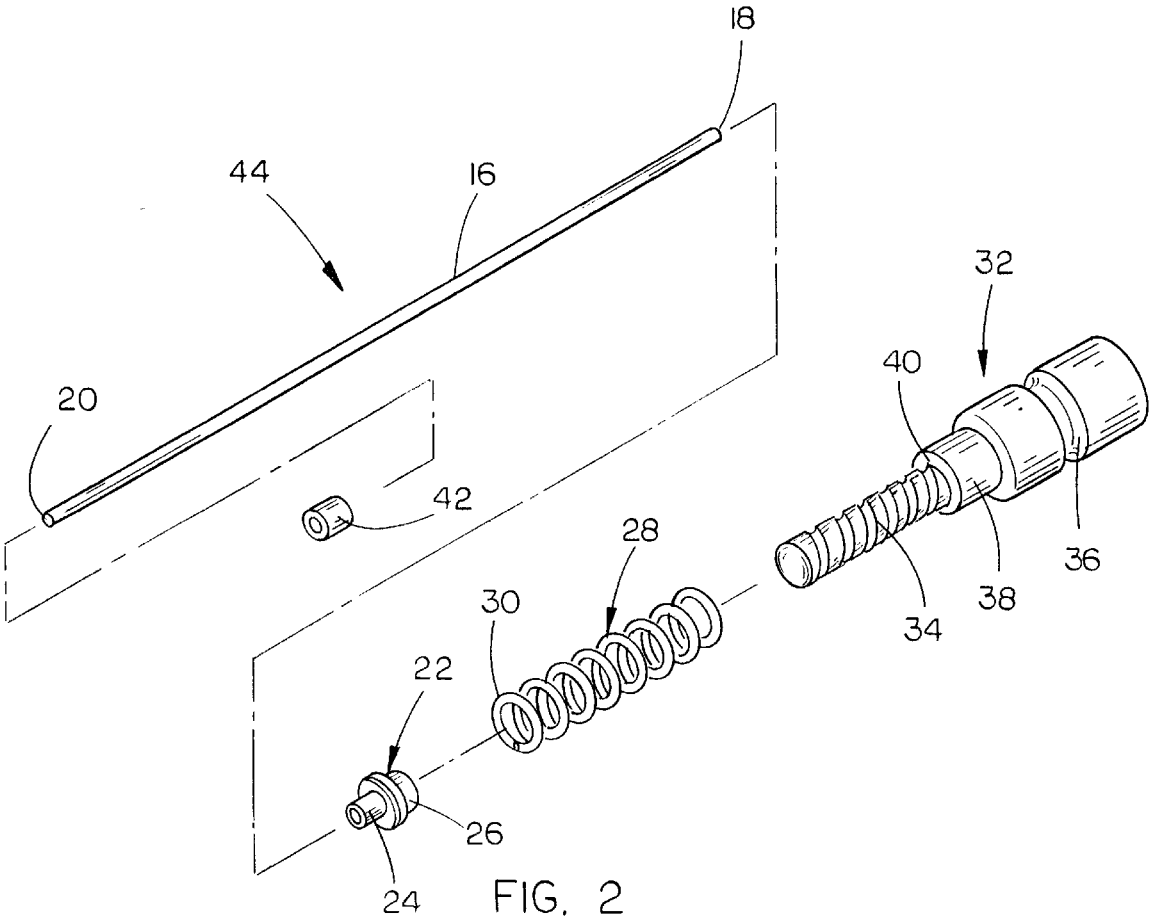
FIG. 2 is an exploded perspective view of the component in the first sub-assembly.

The antenna 10 is fabricated employing the following steps. Referring to FIG. 2, the numeral 16 refers to a conventional elongated metal rod which forms the elongated radiating element of the antenna. For purposes of description, metal rod 16 will be described as having an upper end 18 and a lower end 20. The numeral 22 refers to a metal fitting comprised of brass or the like having a lower end 24 which is adapted to receive the upper end 18 of the metal rod 16. Fitting 22 has its upper end 26 designed so as to receive the lower end 30 of a helical radiating element 28. Lower end 24 of fitting 22 is positioned on the upper end 18 of metal rod 16 and is crimped thereonto. The lower end 30 of spring 28 is positioned on the upper end 26 of the fitting 22 and is crimped and/or soldered thereto. The numeral 32 refers to a threaded location mandrel having a threaded lower end 34 which is adapted to be threaded into the interior of the helical spring 28. Mandrel 32 also includes an annular groove 36 formed therein adapted to receive locator pins 60 and 62 to maintain the mandrel in the injection molding tool as will be described hereinafter. Further, mandrel 32 includes a reduced diameter portion 38 having a shoulder 40 which is adapted to abut against the upper end of the spring 28 when the mandrel is threaded into the spring 28. Referring to FIG. 2, the numeral 42 refers to a sliding bushing holding device which is adapted to be slidably mounted on the rod 16. For purposes of description, the components of FIG. 2 will be referred to as a first sub-assembly 44.

Figure 3:
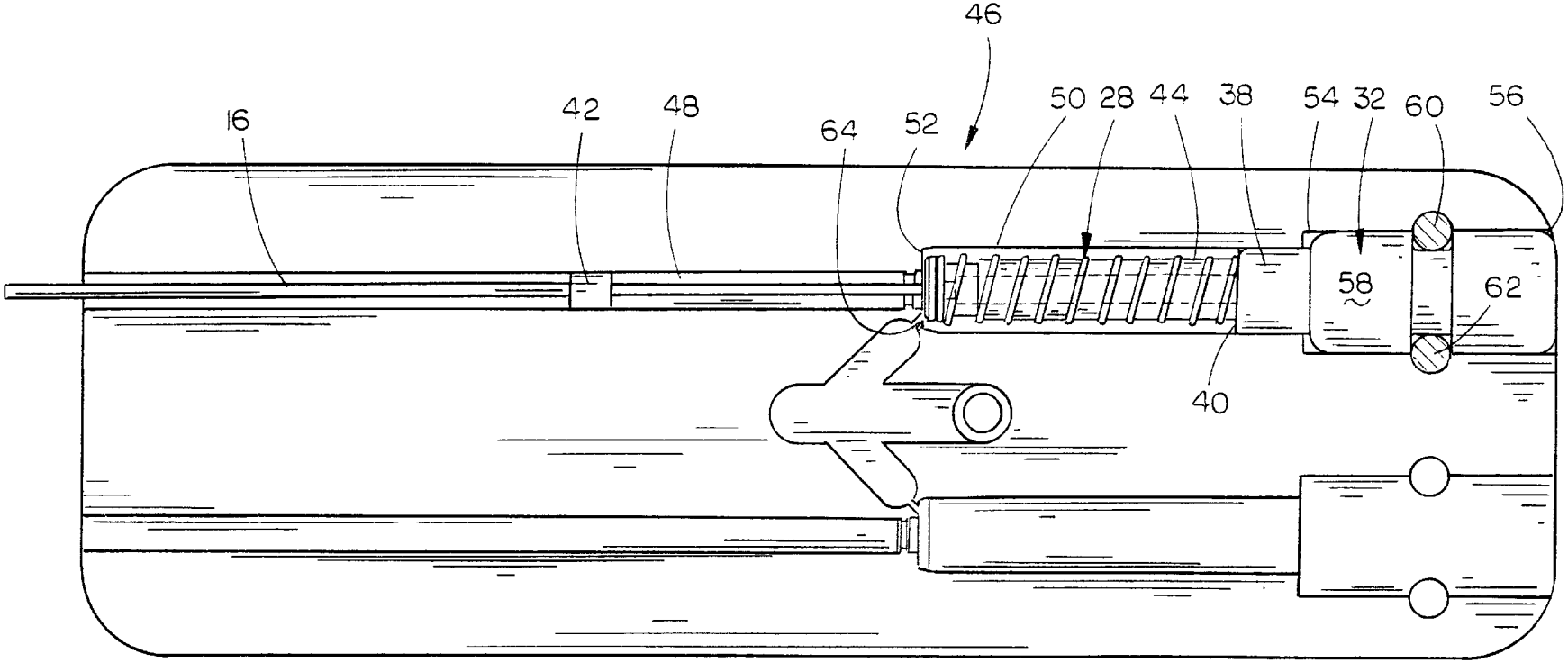
FIG. 3 is a sectional view through a first injection molding tool having the first sub-assembly positioned therein.

One or more of the first sub-assemblies 44 are then placed in the first injection molding tool which is referred to generally by the reference numeral 46 in FIG. 3. Inasmuch as the cavities in the tool 46 are identical for creating each of the individual antennas, only one of the cavities will be described. As seen in FIG. 3, tool 46 includes an elongated cavity 48 having an open end 50. The inner end of cavity 48 communicates with a larger cavity 50 thereby creating a shoulder 52 therebetween. The other end of cavity 50 communicates with a larger cavity 54. If the tool 46 is a two-piece tool split along its central axis, the sub-assemblies 44 may be inserted into the cavities in conventional fashion. The sub-assembly 44 is inserted into one cavity of the tool 46 so that the rod 16 is positioned within the cavity 48 and so that the spring 28 is positioned within the cavity 50. Reduced diameter portion 38 of the threaded location mandrel 32 is positioned in the end of cavity 50 with the larger portion 58 of mandrel 32 being received in cavity 54. Locator pins 60 and 62 are received in the annular groove 36 to maintain the sub-assembly in the tool 46. Initially, the sliding bushing holding device 42 will be positioned as indicated in FIG. 3 to support the metal rod 16 in a central position within the cavity 48. The cavity halves are then closed together.

Figure 4:
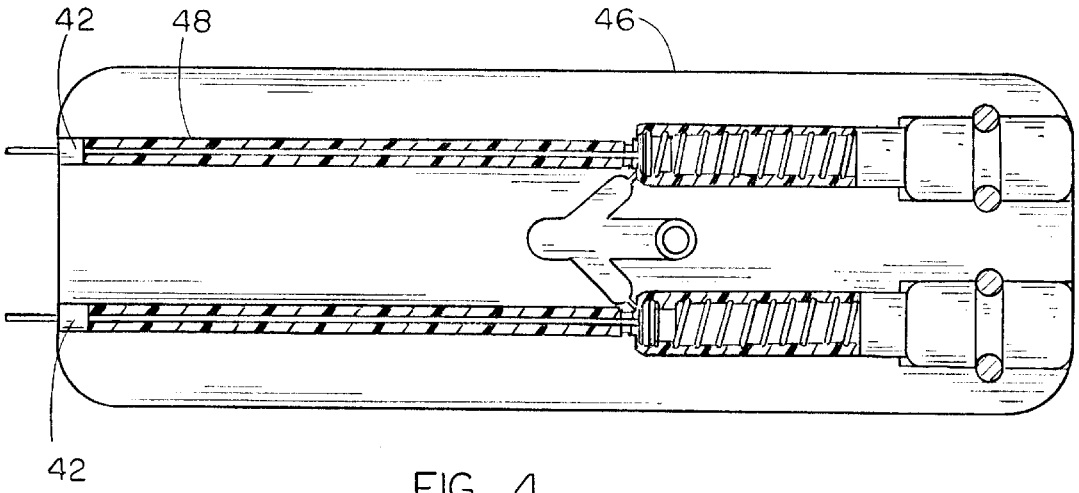
FIG. 4 is a view similar to that of FIG. 3 except that thermoplastic material has been injected into the tool to over-mold a portion of the metal rod and the helical spring.

A suitable thermoplastic polymer material is then injected into the cavities 48 and 50 by means of a runner and gate 64 in conventional fashion. The flowable thermoplastic material enters the cavity 50 and completely surrounds the helical spring 28 which is centrally positioned in the cavity 50 by means of the threaded location mandrel. The threaded location mandrel not only centrally positions the helical spring in the cavity 50, but also maintains the pitch angle of the individual turns of the spring. The thermoplastic material also flows into the inner end of the cavity 48 and flows to the left, as viewed in FIG. 3. The thermoplastic material engages the sliding bushing holding device 42 and slides the same, due to the injection pressure, to the left as viewed in FIG. 3. The thermoplastic material is injected into the cavity 48 until the device 42 has reached the outer end of the cavity 48. As the device 42 slides to the left, as viewed in FIG. 3, the engagement of the device 42 with the rod 16 ensures that the rod 16 will be centrally positioned in the cavity 48 as the rod 16 is being over-molded with the thermoplastic material. FIG. 4 illustrates the sliding bushing holding devices 42 having reached the end of their respective cavities 48.

Figure 5:
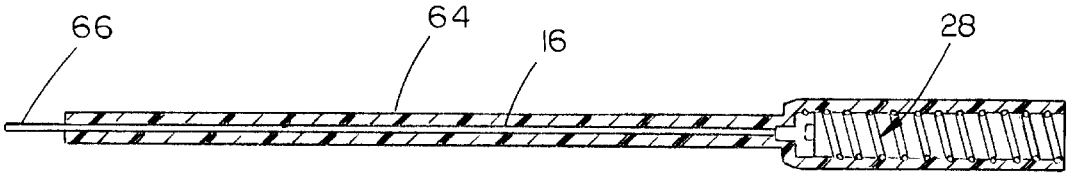
FIG. 5 is a longitudinal sectional view of the antenna prior to over-molding the end of the elongated radiator, prior to the interior of the spring being filled and prior to the end-cap being formed.

The thermoplastic material is then allowed to cure or harden. When the thermoplastic holding material has sufficiently cured, the over-molded sub-assemblies 44 are removed from the tool 46 in conventional fashion. Each of threaded mandrels 32 are then threadably unscrewed from their respective springs with the over-molded sub-assembly being depicted in FIG. 5. As seen in FIG. 5, at this point of the fabrication process, the interior of the spring 28 is hollow and the end thereof is open. Also, the end of the metal rod 16 extends beyond the over-molded plastic material referred to generally by the reference numeral 64. Depending upon the particular use for the antenna, the exposed end portion 66 of the metal rod 16 may be left as is viewed in FIG. 5, or may be cut from the sub-assembly. In most cases, the exposed end portion 66 of metal rod 16 will be subsequently over-molded with the thermoplastic material.

Figure 6:
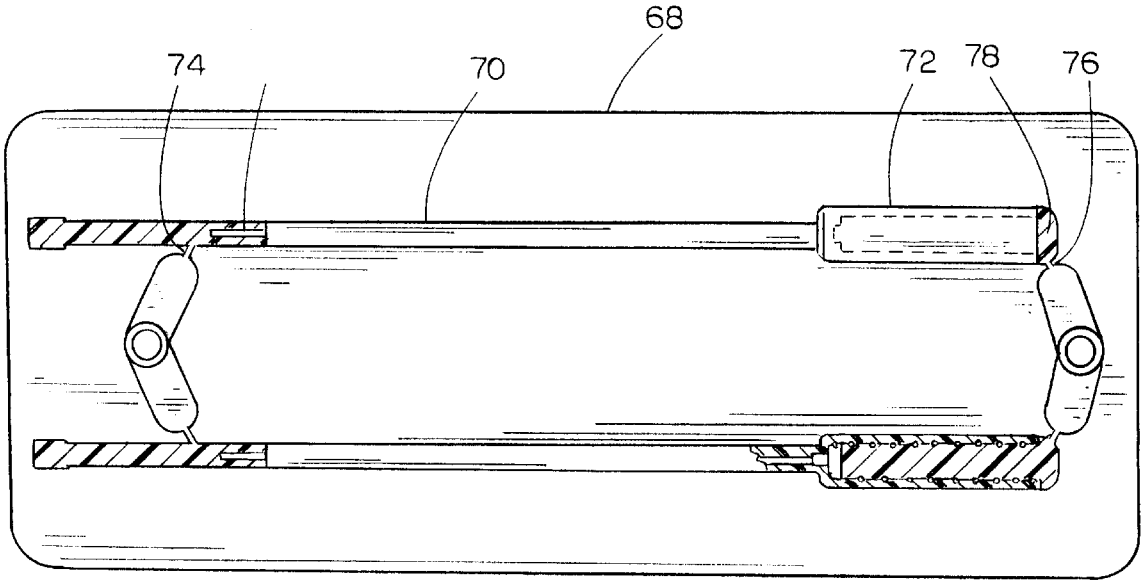
FIG. 6 is a view of one cavity half of a second injection molding tool which illustrates the final step in the over-molding of the antenna.

The over-molded sub-assembly illustrated in FIG. 5 is then placed in a second injection molding tool 68. The tool 68 may have a plurality of cavities formed therein, each of which are adapted to receive a molded sub-assembly therein. Inasmuch as all of the cavities of the tool 68 are identical for accommodating each of the molded sub-assemblies, only one of the cavities will be described. Tool 68 includes a cavity portion 70 which is adapted to receive the over-molded portion of the rod 16 and a cavity portion 72 which is adapted to receive the over-molded portion of the spring 28. As seen in FIG. 6, cavity portion 72 extends beyond the end of the over-molded spring 28. As also seen in FIG. 6, the end of cavity portion 70 extends beyond the end 66 of the metal rod 16.

Thermoplastic material is then introduced into the end of the cavity portion 70 by means of runner and gate 74 to over-mold the end 66 of the rod 16. Thermoplastic material is introduced into the end of cavity portion 32 through the runner and gate 76 to fill the interior of the over-molded spring 28, as illustrated in FIG. 6, and to create an end cap 78. Although FIG. 6 illustrates that the end of the metal rod 16 is over-molded and the end caps are formed in a single tool, they obviously could be formed in separate injection molding operations although it is preferred that the two molding operations be conducted simultaneously.

Figure 7:
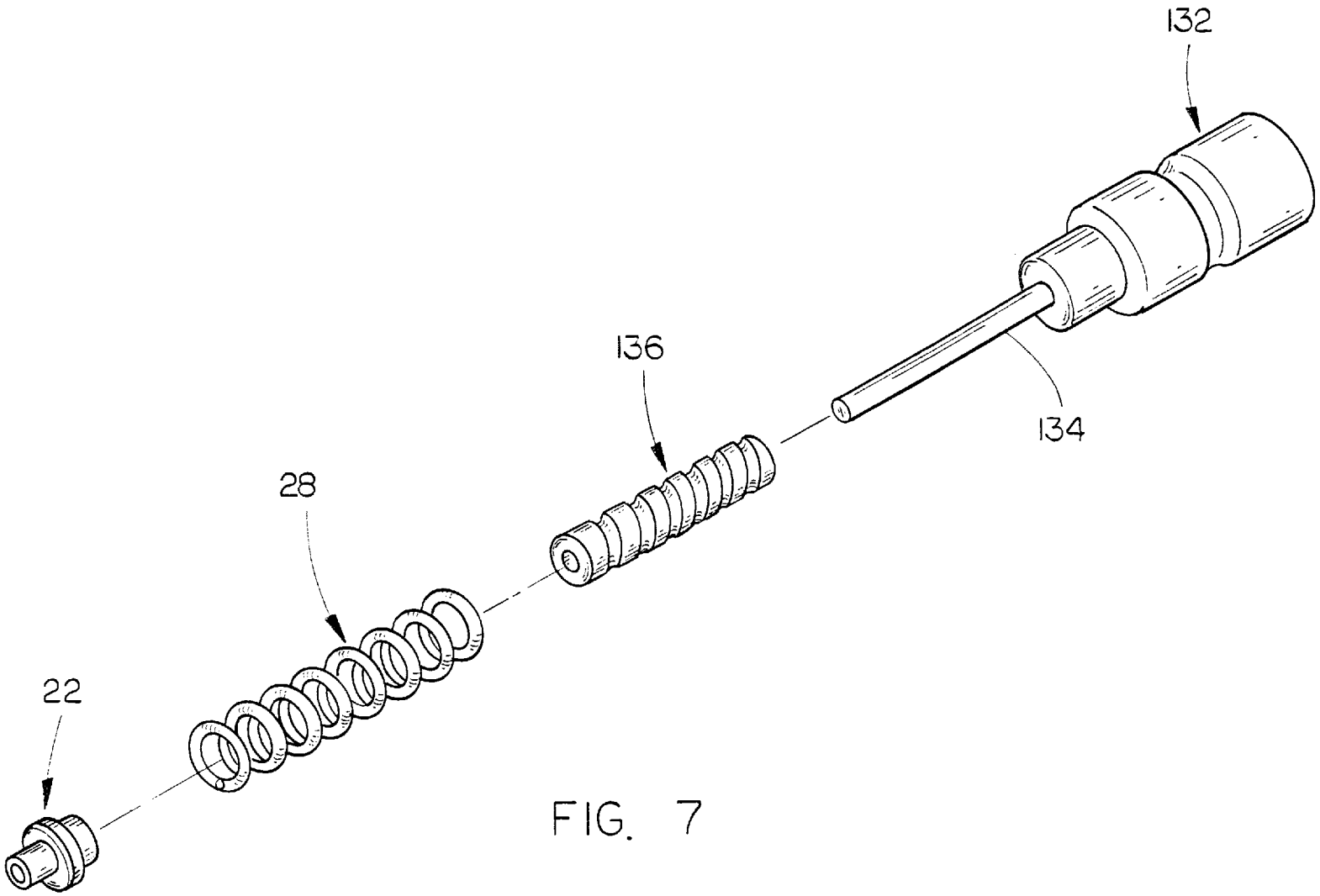
FIG. 7 is a perspective view of a modified form of the mandrel of FIG. 2.

Although it is preferred to utilize a threaded location mandrel such as previously described, there are other possible alternatives to properly locate the spring 28 during the over-molding process. One approach would be the coil form approach. That is, install a molded coil form into the spring and over-mold it for permanent placement therein. FIG. 7 is a perspective view of the coil form approach. As seen in FIG. 7, the numeral 132 refers to a location mandrel similar to the location mandrel 32 of FIG. 2 except that the mandrel 132 does not have the threaded lower end 34 present on mandrel 32. Mandrel 132 includes an elongated rod or pin 134 which extends therefrom and which is adapted to receive a plastic coil form 136 which is screwed into the spring 28. The reason for providing the plastic coil form 136 rather than the threaded lower end on the mandrel is that the plastic coil form 136 may be left in the spring 28, after molding, without the necessity of unscrewing the mandrel 132 from the spring as in the embodiment of FIG. 2.

A second approach would be to use a collapsible core assembly. A collapsible core coil form in the spring would hold the pitch during the over-molding process instead of having to screw and unscrew a mandrel.

Thus it can be seen that a novel method of over-molding an antenna has been described which ensures that the fragile and delicate components thereof are properly positioned within the molding material. By over-molding the entire antenna sub-assembly, applicants have eliminated several seams, steps, and transitions and have improved the appearance of the finished product. The strength of the antenna is also enhanced. By over-molding the entire internal sub-assembly, applicants have used the strength of the thermoplastic polymer to tie all of the separate pieces of the antenna sub-assembly together to create a stronger and more robust finished product. The method of this invention also reduces the number of components normally associated with the assembly of an antenna.

Thus it can be seen that the invention accomplishes at least all of its stated objectives.

We claim:

1. The method of assembling an antenna and over-molding the same with a thermoplastic material, comprising the steps of:

providing an elongated metal rod, metal fitting and elongated helical metal spring;

said metal rod having first and second ends;

said helical spring having first and second ends;

securing the said metal fitting to said first end of said metal rod;

securing said first end of said spring to said metal fitting to create a first sub-assembly;

placing said first sub-assembly into a first injection molding tool, said first injection molding tool having a first elongated cavity for receiving said metal rod therein and a second cavity for receiving said spring;

introducing a flowable thermoplastic material into said first and second cavities of said first injection molding tool to cover substantially all of said metal rod, to cover said metal fitting, and to cover the exterior of said spring except for said second end thereof;

centering said metal rod in said first elongated cavity during the injection of said thermoplastic material therein;

centering said helical spring in said second cavity during the injection of said thermoplastic material therein;

maintaining the spring pitch distance of said spring during the injection of said thermoplastic material into said second cavity;

allowing the thermoplastic material to cure for a predetermined length of time;

removing the over-molded first sub-assembly from said first injection molding tool;

placing said over-molded first sub-assembly into a second injection molding tool, said second injection molding tool having a first cavity formed therein for receiving the over-molded metal rod, a second cavity formed therein for receiving said over-molded spring, and a third cavity located at said second end of said spring;

and introducing a flowable thermoplastic material into said third cavity to fill the interior of said over-molded spring and to create an end cap for the antenna.

2. The method of claim 1 wherein a location mandrel is inserted into the said second end of said spring to create said first sub-assembly and wherein said location mandrel is removed from said spring during the molding operation in said second injection molding tool.

3. The method of claim 1 wherein a sliding bushing holding device is mounted on said metal rod to centrally position said metal rod in said first cavity as said thermoplastic material is injected into said first cavity.

4. The method of claim 1 wherein said flowable thermoplastic material is inserted into said first cavity to over-mold any exposed portion of said second end of said metal rod.

5. The method of assembling an antenna and over-molding the same with a thermoplastic material, comprising the steps of:

providing an elongated metal rod, metal fitting and elongated helical metal spring;

said metal rod having first and second ends;

said helical spring having first and second ends;

securing the said metal fitting to said first end of said metal rod;

securing said first end of said spring to said metal fitting;

inserting a coil form into the interior of said helical spring to create a first sub-assembly;

placing said first sub-assembly into a first injection molding tool, said first injection molding tool having a first elongated cavity for receiving said metal rod therein and a second cavity for receiving said spring;

introducing a flowable thermoplastic material into said first and second cavities of said first injection molding tool to cover substantially all of said metal rod, to cover said metal fitting, and to cover the exterior of said spring except for said second end thereof;

centering said metal rod in said first elongated cavity during the injection of said thermoplastic material therein;

centering said helical spring in said second cavity during the injection of said thermoplastic material therein;

maintaining the spring pitch distance of said spring during the injection of said thermoplastic material into said second cavity through the use of said coil form;

allowing the thermoplastic material to cure for a predetermined length of time;

removing the over-molded first sub-assembly from said first injection molding tool;

placing said over-molded first sub-assembly into a second injection molding tool, said second injection molding tool having a first cavity formed therein for receiving the over-molded metal rod, a second cavity formed therein for receiving said over-molded spring, and a third cavity located at said second end of said spring;

and introducing a flowable thermoplastic material into said third cavity to create an end cap for the antenna.

* * * * *